US009335053B2

(12) United States Patent
Chang et al.

(10) Patent No.: US 9,335,053 B2
(45) Date of Patent: May 10, 2016

(54) GAS IGNITION SWITCH

(75) Inventors: Pao-Chi Chang, Shihgang Township, Taichung County (TW); Shu-Mei Liu, Shihgang Township, Taichung County (TW)

(73) Assignee: SEVEN UNIVERSE INDUSTRIAL CO., LTD., Taichung County (TW)

( * ) Notice: Subject to any disclaimer, the term of this patent is extended or adjusted under 35 U.S.C. 154(b) by 844 days.

(21) Appl. No.: 13/611,634

(22) Filed: Sep. 12, 2012

(65) Prior Publication Data

US 2014/0072918 A1 Mar. 13, 2014

(51) Int. Cl.
*F23Q 7/12* (2006.01)
*F24C 3/12* (2006.01)

(52) U.S. Cl.
CPC ..... *F24C 3/126* (2013.01)

(58) Field of Classification Search
CPC ..... F23N 1/005; F23N 1/04; F23N 1/007; F23N 2027/36; F23C 1/08; F23C 13/02; F23C 2202/10; F23C 2900/06041; F23C 3/002; F23C 3/004; F23C 9/003; F23C 3/103; F23K 2301/206; F23K 5/147; F24H 3/006; F24H 1/20; F23Q 9/00; F23Q 7/02; F23Q 7/04; F23Q 7/06; F23Q 7/08; F23Q 7/10; F23Q 7/12; F24C 3/12; F24C 3/126; H01H 3/0206
USPC ..... 200/61.85; 361/247, 253; 431/256, 254, 431/255, 257
See application file for complete search history.

(56) References Cited

U.S. PATENT DOCUMENTS 3,989,445 A * 11/1976 Kojima ..... F23Q 2/285 431/256

FOREIGN PATENT DOCUMENTS

JP 2003130333 A * 5/2003

* cited by examiner

*Primary Examiner* — Kenneth Rinehart
*Assistant Examiner* — Jason Lau
(74) *Attorney, Agent, or Firm* — Ming Chow; Sinorica, LLC

(57) ABSTRACT

The present invention provides an improved gas ignition switch, which comprises a gas switch main body, a closer assembly, a knob assembly, a pressing plate, a inching switch and an electronic ignition device, and the outside of the gas switch main body is further configured with an enclosure. The enclosure covers the inching switch and the corresponding pressing plate, so as to separate the corresponding positions of the inching switch and the pressing plate from the outside environment.

10 Claims, 5 Drawing Sheets

GAS IGNITION SWITCH

BACKGROUND OF INVENTION

1. Field of the Invention

The present invention relates generally to a gas switch, and more particularly to a gas ignition switch which can ensure normal activation of the inching switch.

2. Description of Related Art

For the purpose of one-time ignition, currently most gas switches are configured with an electronic ignition device and an inching switch electrically connected with the electronic ignition device. Moreover, the turning axle of the gas switch knob is further configured with a pressing plate corresponding to the inching switch, so that when the user turns and presses the knob, the pressing plate can be displaced to contact the activation point of the inching switch, and the inching switch will be activated, causing the electronic ignition device to generate sparks to ignite the gas output from the gas switch. In this way, the gas switch can complete the ignition in one time.

However, in the prior-art gas switches, the inching switch is usually locked on the outside of the gas switch main body, or on an extra frame provided outside the gas switch main body, and therefore, the pressing plate and the activation point of the inching switch is in an exposed state. Gas switches with such a configuration may have occasional failures during operation (for example, the inching switch may be activated when the knob is not turned to the preset angle). The above condition is usually caused by a foreign object or an insect which falls or invades into the gas oven and happens to locate between the activation point of the inching switch and the pressing plate (particularly in case of outdoor meat-baking ovens), and consequently changes the correct travel when the pressing plate contacts the activation point of the inching switch.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

SUMMARY OF THE INVENTION

Hence, to achieve the above goal, the present invention provides an improved gas ignition switch, which comprises such components as a gas switch main body, a closer assembly, a knob assembly, a pressing plate, a inching switch and an electronic ignition device; characteristically, it further comprises an enclosure, enclosing the outside of the inching switch and connecting to the gas switch main body, to shield the inching switch and the corresponding pressing plate.

DETAILED DESCRIPTION OF THE INVENTION

Figure 1:
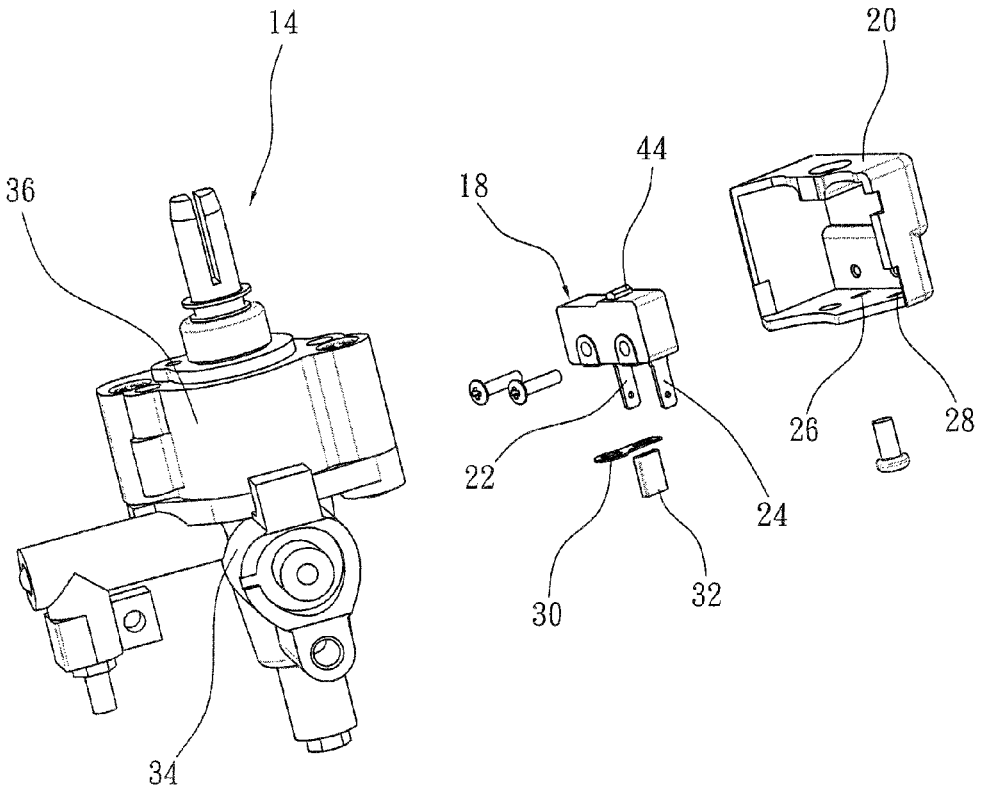
FIG. 1 is an exploded perspective view of the first preferred embodiment of the present invention.
Figure 2:
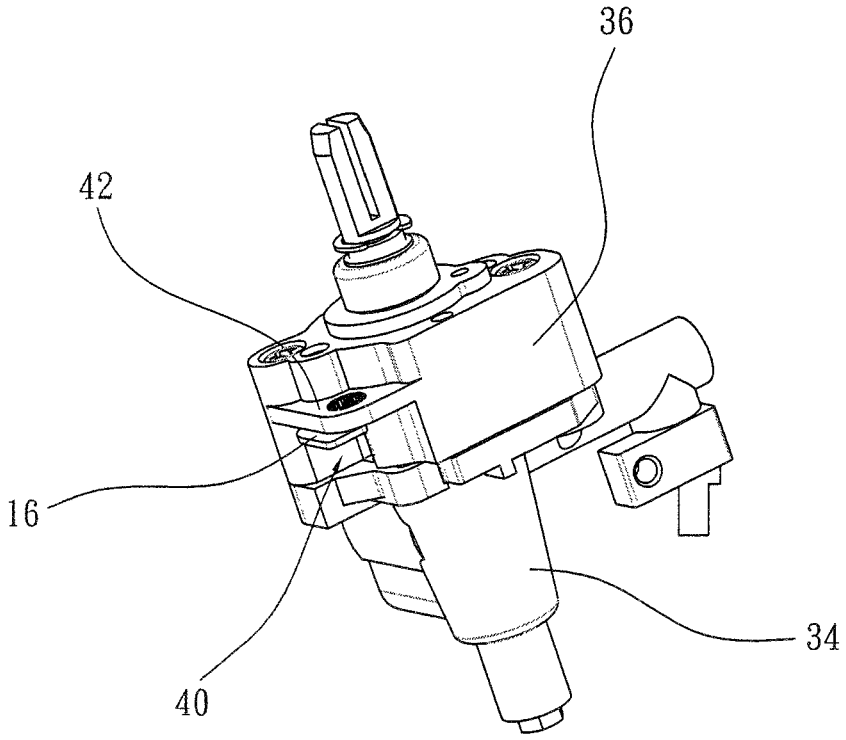
FIG. 2 is a part perspective view of the first preferred embodiment of the present invention.
Figure 3:
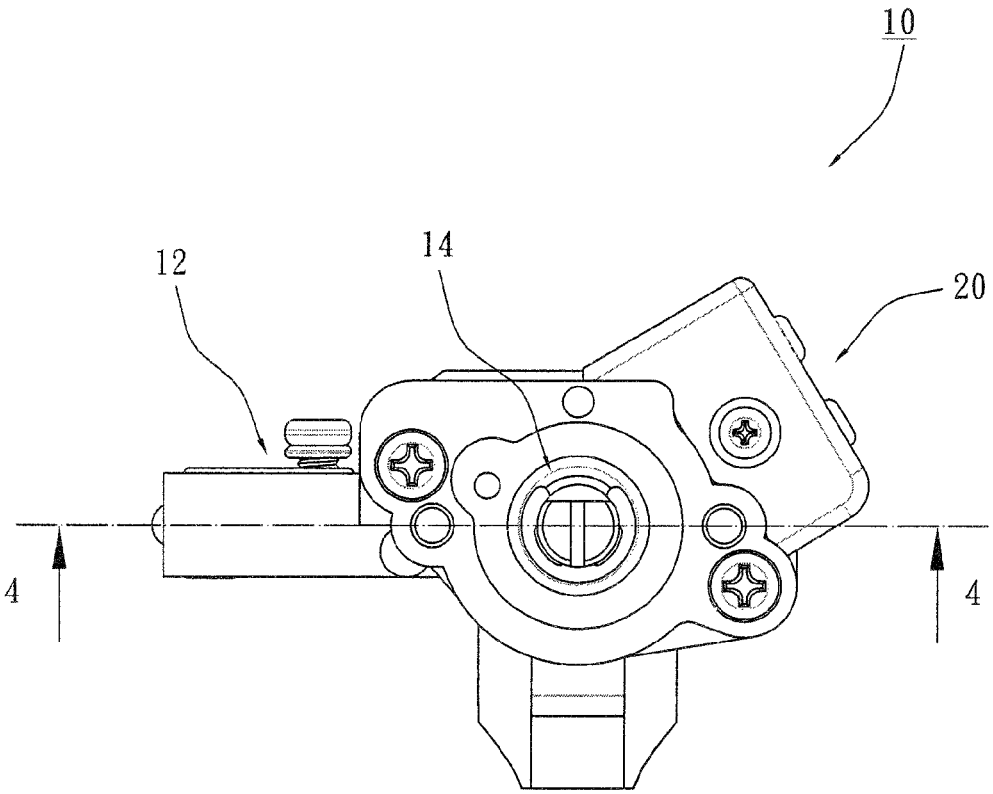
FIG. 3 is a top rear view of the first preferred embodiment of the first present invention.
Figure 4:
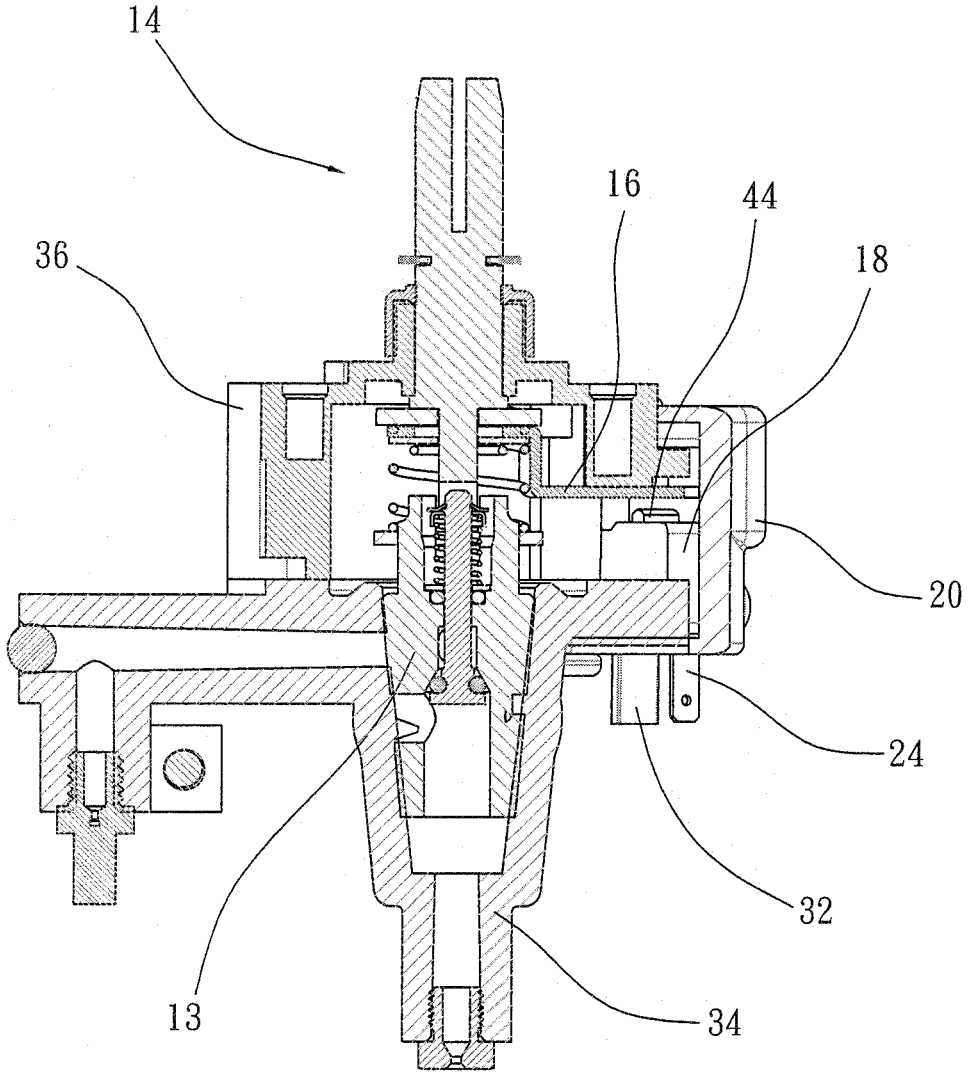
FIG. 4 is a sectional view along 4-4 cross section in FIG. 3.

Below is a detailed description of the present invention based on a preferred embodiment and the accompanied drawings:

Firstly, referring to FIGS. 1 to 4, as a preferred embodiment of the present invention, the gas ignition switch 10 comprises a gas switch main body 12, a closer assembly 13, a knob assembly 14, a pressing plate 16, a inching switch 18 and an electronic ignition device, wherein the electronic ignition device is not shown in the drawing; the above components are all prior art and their constructions and functions are therefore not detailed here; characteristically, the gas ignition switch 10 of the present invention further comprises:

An enclosure 20, roughly in the shape of a shell with an opening on one side, locked on one side of the gas switch main body 12 with the opening facing inward, for the inching switch 18 to be locked inside; the first and second conducting terminals 22, 24 of the inching switch 18 extend out of the first through-hole 26 and second through-hole 28 provided on the bottom of the enclosure 20; the first conducting terminal 22 goes through one end of the conducting plate 30; the other side of the conducting plate 30 contacts against the main body 12 of the gas switch for grounding effect; a cap 32 made of insulation material covers the end of the first conducting terminal 22 protruding out of the enclosure 20, and the second conducting terminal 24 is electrically connected to the ignition device.

Furthermore, the gas switch main body 12 comprises a seat body 34 and a cap body 36. The closer assembly 13 is configured on the seat body 34, the knob assembly 14 and pressing plate 16 is configured on the cap body 36. One side of the seat body 34 is provided with a concave 40, which constitutes a space to house the inching switch 18. On the position of the cap body 36 corresponding to the concave 40, a fixing plate 42 is configured. The fixing plate 42 corresponds to the pressing plate 16 and the activation point 44 of the inching switch 18. The enclosure 20 covers the outside of the concave 40 and the fixing plate 42 and locks the fixing plate 42.

Based on the above components, the operation of the gas ignition switch 10 of the present invention is almost same as the conventional gas switches, except that the pressing plate 16 can also be used to drive the inching switch 18 to complete one-time ignition. The characteristics and efficacies of the present invention are as follow:

As the inching switch 18 is configured inside the enclosure 20 and the pressing plate 16 is also shielded by the enclosure 20, the activation point 44 of the inching switch 18 and the pressing plate 16 are protected by the enclosure 20 and are not exposed, avoiding such conditions that a foreign object will fall between the pressing plate 16 and the activation point 44, or an insect will come in to affect the pressing plate 16 driving the inching switch 18 and therefore normal operation of the gas ignition switch 10 can be ensured.

Secondly, the first conducting terminal 22 of the inching switch 18 is electrically connected to the conducting plate 30 for grounding effect, and the conducting plate 30 is located inside the enclosure 20, different from the grounding style of prior-art gas switches having an grounding cord extending to the outside of the gas switch, so that the appearance of the gas ignition switch 10 is more integral and compact than the prior-art gas switches.

Figure 5:
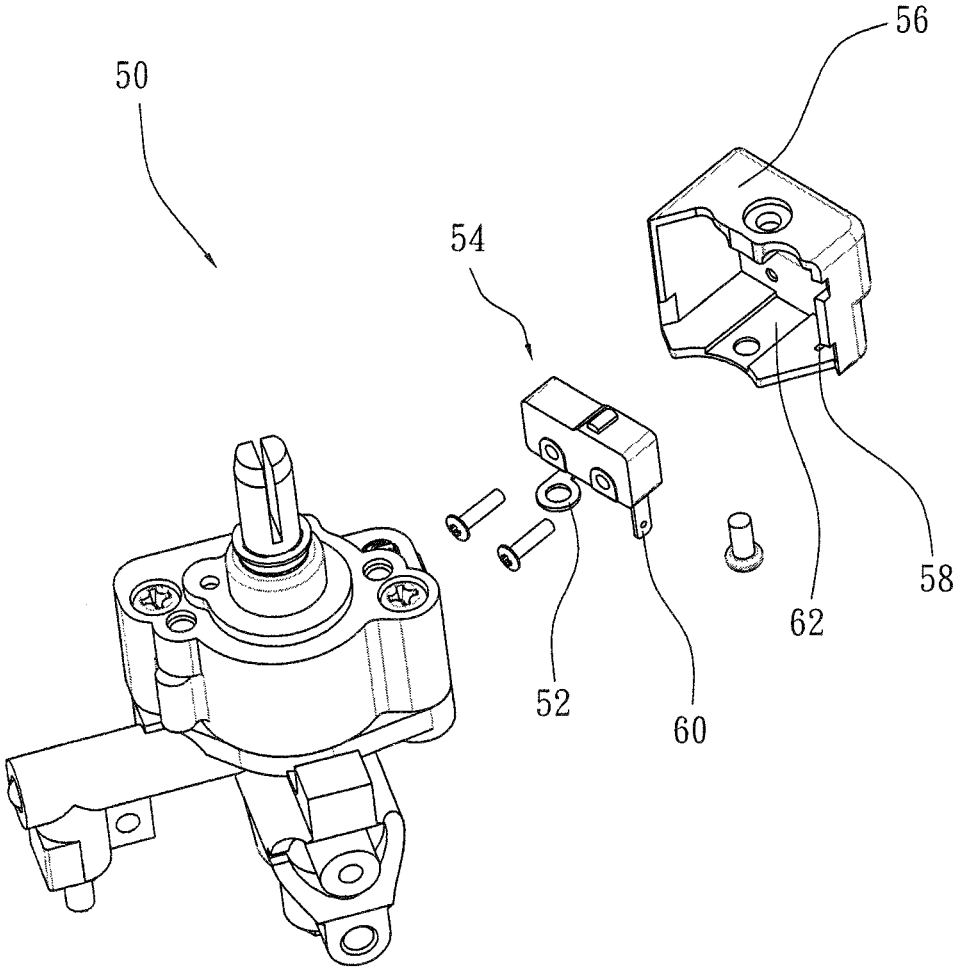
FIG. 5 is an exploded perspective view of the second preferred embodiment of the present invention.

FIG. 5 shows a gas ignition switch 50 as second preferred embodiment of the present invention. Its construction is almost the same as the gas ignition switch 10. Differences are: its conducting plate 52 is integrally formed with the first conducting terminal of the inching switch 54, and the inside of its enclosure 56 is only configured with one through-hole 58 for the second conducting terminal 60 to go through and protruding out of the enclosure 56, and also, the inside of the enclosure 56 is provided with a concave groove 62 to house the conducting plate 54. In this way, the above-disclosed cap 32 can be omitted, and the overall structure becomes more compact, and assembly of the inching switch 54 and enclosure 56 will be more convenient and faster.

To summarize, the gas ignition switch provided by the present invention can not only complete one-time ignition, but also avoid foreign objects or insects to affect the activation of the inching switch, and ensure normal ignition. Hence, the present invention has a practical value.

Although the invention has been explained in relation to its preferred embodiment, it is to be understood that many other possible modifications and variations can be made without departing from the spirit and scope of the invention as hereinafter claimed.

What is claimed is:

1. An improved gas ignition switch, comprising a gas switch main body, a closer assembly, a knob assembly, a pressing plate, a inching switch and an electronic ignition device; characteristically, it further comprises:

an enclosure, covering the outside of the inching switch and connected with the gas switch main body, to shield the inching switch and the corresponding pressing plate;

the inching switch is fixed on the inside of the enclosure and corresponds to the pressing plate;

the first conducting terminal of the inching switch is connected with the gas switch main body, while the second conducting terminal is electrically connected with the electronic ignition device; and the gas switch main body comprises a seat body and a cap body, with the closer assembly configured on the seat body and the knob assembly and pressing plate configured on the cap body; one side of the seat body is provided with a concave; on the position of the cap body corresponding to the concave, a fixing plate is configured; the enclosure covers the outside of the concave and the fixing plate and is connected with the fixing plate.

2. The device defined in claim 1, which further comprises a conducting plate, which connects the first conducting terminal with the gas switch main body and is located on the inside of the enclosure.

3. The device defined in claim 1, wherein the fixing plate corresponds to the pressing plate and the activation point of the inching switch.

4. The device defined in claim 2, wherein the enclosure is roughly in the shape of a shell with an opening on one side; it is one side is configured with a first through-hole and a second through-hole; the first and second conducting terminals of the inching switch respectively extend out of the first and second through-holes and protrude out of the enclosure.

5. The device defined in claim 1, wherein the enclosure is roughly in the shape of a shell with an opening on one side; it is one side is configured with a first through-hole and a second through-hole; the first and second conducting terminals of the inching switch respectively extend out of the first and second through-holes and protrude out of the enclosure.

6. The device defined in claim 5, wherein one end of the first conducting terminal protruding out of the enclosure is further configured with a cap, which is made of insulation material.

7. The device defined in claim 2, wherein the conducting plate is integrally formed with the first conducting terminal, and the inside of the enclosure is provided with a concave groove to house the conducting plate.

8. The device defined in claim 7, wherein the enclosure is roughly in the shape of a shell with opening on one side, with its one side configured with a through-hole, for the second conducting terminal of the inching switch to go through and protrude out of the enclosure.

9. The device defined in claim 5, wherein the conducting plate is integrally formed with the first conducting terminal, and the inside of the enclosure is configured with a concave groove to house the conducting plate.

10. The device defined in claim 9, wherein the enclosure is roughly in the shape of shell with opening on one side, with its one side configured with a through-hole, for the second conducting terminal of the inching switch to go through and protrude out of the enclosure.

* * * * *